US007275476B2

(12) United States Patent
Naumann et al.

(10) Patent No.: US 7,275,476 B2
(45) Date of Patent: Oct. 2, 2007

(54) OSCILLATING MOTOR FOR A CAMSHAFT ADJUSTING DEVICE

(75) Inventors: Ralf Naumann, Crimmitschau (DE); Gerold Sluka, Nurtingen (DE); Frank Heidl, Lorsch (DE); Andreas Knecht, Kusterdingen (DE)

(73) Assignee: Hydraulik-Ring GmbH, Marktheidenfeld (DE)

( * ) Notice: Subject to any disclaimer, the term of this patent is extended or adjusted under 35 U.S.C. 154(b) by 58 days.

(21) Appl. No.: 10/604,530

(22) Filed: Jul. 29, 2003

(65) Prior Publication Data

US 2004/0177751 A1 Sep. 16, 2004

(30) Foreign Application Priority Data

Jul. 31, 2002 (DE) ..... 102 34 867.7

(51) Int. Cl.
*F01C 9/00* (2006.01)

(52) U.S. Cl. ..... 92/121

(58) Field of Classification Search ..... 92/121, 92/122

See application file for complete search history.

(56) References Cited

U.S. PATENT DOCUMENTS 2,256,470 A * 9/1941 Peo et al. ..... 92/122
2,339,042 A * 1/1944 Anderson ..... 92/122
2,902,009 A * 9/1959 Ludwig et al. ..... 92/121
3,032,020 A * 5/1962 Sneen ..... 92/122
5,201,637 A * 4/1993 Folland et al. ..... 92/122
6,014,952 A 1/2000 Sato et al. ..... 123/90.17
2002/0029651 A1 3/2002 Sluka et al. ..... 74/567

FOREIGN PATENT DOCUMENTS

| | | |
|---|---|---|
| DE | 100 29 261 | 12/2001 |
| JP | 09 -209723 | 8/1997 |
| JP | 10 -238319 | 9/1998 |
| JP | 11 - 093626 | 6/1999 |

* cited by examiner

*Primary Examiner*—F. Daniel Lopez
(74) *Attorney, Agent, or Firm*—Gudrun E. Huckett

(57) ABSTRACT

An oscillating motor for a camshaft adjusting device has a stator and a rotor mounted so as to be rotatable relative to one another. The stator has an inner wall and radially extending stator vanes connected to the inner wall. The rotor has a base member and radially extending rotor vanes connected to the base member. The rotor vanes have an end face, respectively, resting against the inner wall of the stator. The stator vanes have an end face, respectively, resting against a peripheral wall of the base member. The rotor vanes taper discontinuously from the end face of the rotor vanes, respectively, in a direction toward the base member so that the rotor vanes each have a widened section at the end face, respectively.

13 Claims, 4 Drawing Sheets

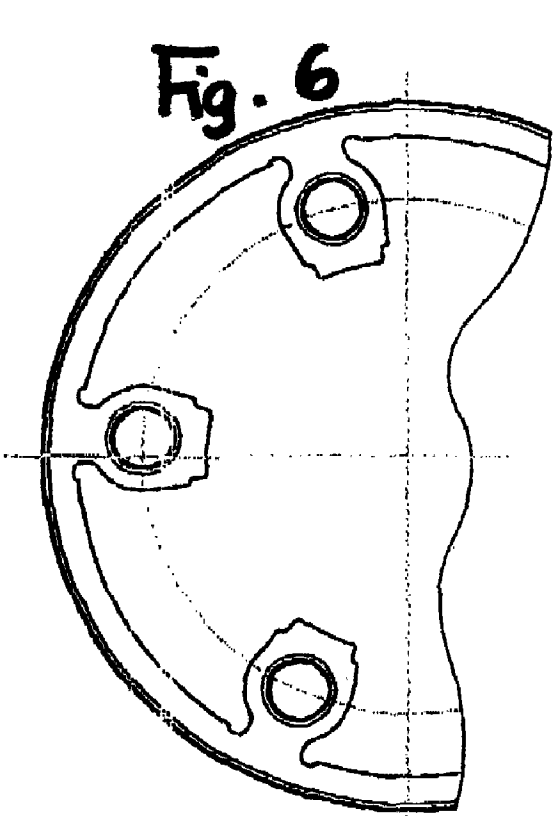
Fig.4
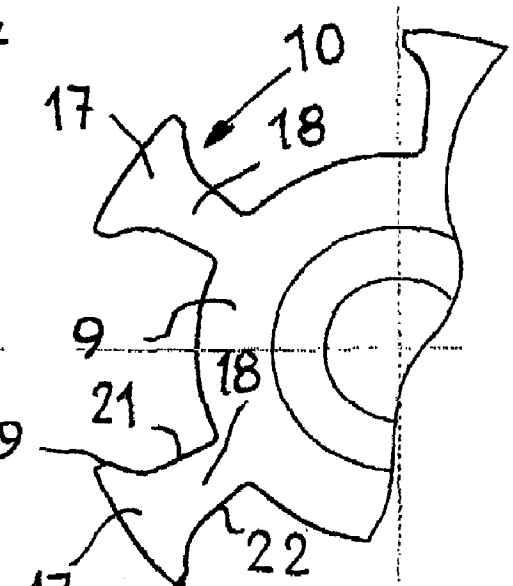
Fig. 5
Fig. 6

OSCILLATING MOTOR FOR A CAMSHAFT ADJUSTING DEVICE

BACKGROUND OF INVENTION

1. Field of the Invention

The invention relates to an oscillating motor for a camshaft adjusting device. The oscillating motor comprises a stator and a rotor rotatable relative to one another and provided with radially extending vanes. The end faces of the vanes of the rotor rest against the inner wall of the stator and the end faces of the stator vanes rest against the peripheral surface of the base member of the rotor.

2. Description of the Related Art

Oscillating motors for camshaft adjusting devices comprise a stator and a rotor arranged coaxially relative to one another. The rotor and the stator are provided with vanes. The rotor vanes are positioned with their end faces on the inner wall of the stator and can be moved between two neighboring stator vanes which rest with their end faces seal-tightly against the base member of the rotor. The rotor vanes separate the chamber formed between two stator vanes, respectively, into two pressure chambers. Depending on the load of the pressure medium in one of the pressure chambers, the rotor is rotated relative to the stator in one or the other direction. The rotor is fixedly mounted on the camshaft and effects in this way adjustment of the camshaft relative to the crankshaft in order to adjust the opening duration of the gas exchange valves of an internal combustion engine to the momentarily required output of the engine. In operation of the oscillating motor, leakage may occur between the end face of the rotor vanes and the inner wall of the stator so that the function of the oscillating motor is impaired.

SUMMARY OF INVENTION

It is an object of the present invention to configure an oscillating motor of the aforementioned kind such that the leakage losses are at least kept at a minimum and that the oscillating motor enables a reliable adjustment of the camshaft over its service life.

In accordance with the present invention, this is achieved in that the rotor vanes taper discontinuously, beginning at their end face, in a direction toward the base member of the rotor.

In the oscillating motor according to the invention, the special configuration of the rotor vanes provides for an increase of the gap length between the end face of the rotor vanes and of the inner wall of the stator without impairing the oscillating angle of the rotor relative to the stator for a predetermined size of the oscillating motor according to the invention. As a result of the great width of the radially outer section of the rotor vane, the gap length between the end face of the rotor vane and the inner wall of the stator is enlarged so that the sealing action between the two pressure chambers is optimized. The oscillating motor according to the invention therefore has only minimal leakage so that the functional limits of the camshaft adjusting device can be broadened. Despite widening of the radially outer section of the rotor vanes, the oscillating angle of the rotor relative to the stator is not reduced for a predetermined size of the motor because widening of the rotor vane is discontinuous. The radially inner section of the rotor vane can therefore be narrow so that the oscillating angle of the rotor is not reduced.

BRIEF DESCRIPTION OF DRAWINGS

FIG. 4 shows a second embodiment of the oscillating motor according to the invention in an illustration corresponding to FIG. 1.

FIG. 5 the second embodiment of the oscillating motor according to the invention an illustration corresponding to FIG. 2.

FIG. 6 shows the second embodiment of the oscillating motor according to the invention in an illustration corresponding to FIG. 3.

DETAILED DESCRIPTION

Figure 3:
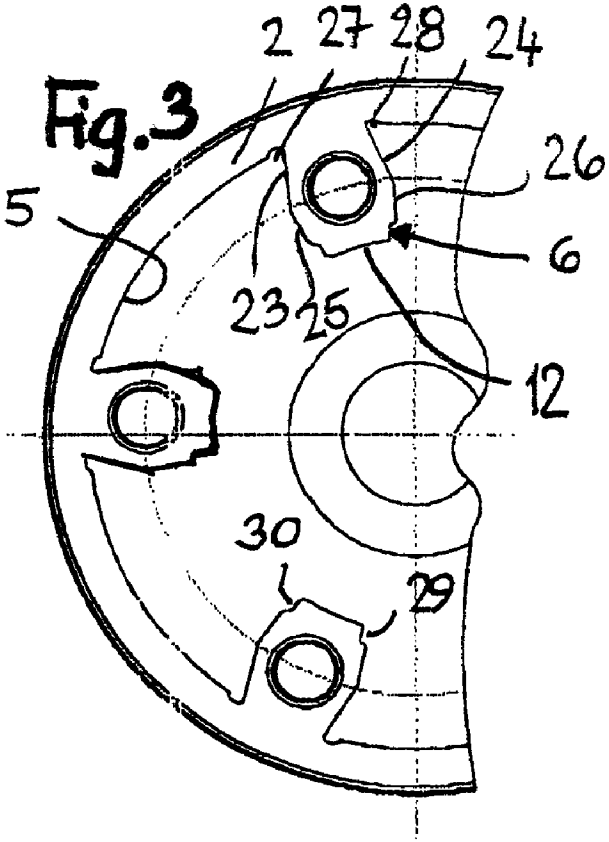
FIG. 3 shows a portion of the stator of the oscillating motor according to FIG. 1 in axial view.

The oscillating motor is used in connection with a camshaft adjusting device which is used in motor vehicles for a targeted adjustment of the opening duration of gas exchange valves of an internal combustion engine. Such camshaft adjusting devices and the corresponding oscillating motors are known and will therefore not be explained in more detail in this connection.

The oscillating motor according to the prior art (FIG. 10) has a stator 1 with a cylindrical housing 2 closed off at one end by a bottom 3 and at the other end by an attached cover (not illustrated). The stator 1 is in driving connection with a chain wheel 4 on which the chain (not illustrated) of the camshaft adjusting device is guided. Stator vanes 6 project from the cylindrical inner wall 5 of the housing 2 radially inwardly; they are arranged in uniform distribution in the circumferential direction and are identical. The stator vanes 6 are formed as a unitary or monolithic part of the housing 2. Between neighboring vanes 6 pressure chambers 7 are formed into which a pressure medium, preferably a hydraulic oil, is introduced.

The housing bottom 3 and the cover (not illustrated) have a central opening through which the camshaft (not illustrated) projects. The rotor 8 is fixedly mounted on the camshaft for common rotation. The rotor 8 has a cylindrical base member 9 on which radially outwardly projecting rotor vanes 10 are provided. They are advantageously formed as a monolithic part of the base member 9 and have identical shape. The rotor vanes 10 rest with their end faces 11 areally on the inner wall 5 of the stator housing 2. The stator vanes 6 rest areally with their end faces 12 on the cylindrical peripheral surface 13 of the base member 9.

By means of the rotor vanes 10, the chambers 7 receiving the pressure medium are separated into two pressure chambers 14 and 15. In the illustrated embodiment, the rotor vanes 10 rest against the stator vanes 6. In this case, the pressure medium within the pressure chambers 15 is pressurized. The medium which is present in the pressure chamber 14 is displaced upon rotation of the rotor 8 relative to the stator 1, as is known in the art, toward the tank. When the rotor 8 is to be rotated counterclockwise, the pressure chambers 15 are relieved and the pressure medium contained in the pressure chambers 14 is pressurized. At least one valve is provided for this switching action.

The pressure chambers 14, 15 must be sealed reliably relative to one another so that the rotor 8 rests reliably against the sidewalls of the stator vanes 6 in the end position, respectively, and so that the rotor can reliably move into any intermediate position and can stay in that position. The end faces 11 of the rotor vanes 10 are relatively short in the rotational direction so that leakage via the sealing gap 16 between the inner wall 5 of the stator housing 2 and the end faces 11 of the rotor vanes 10 is relatively high.

Figure 2:
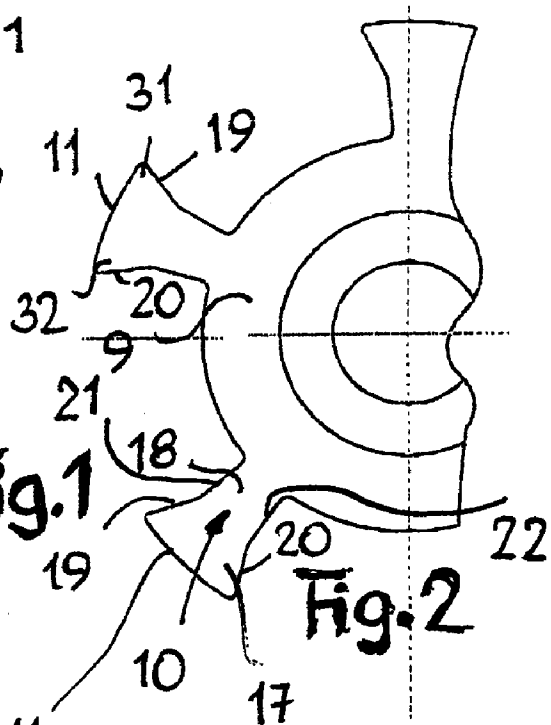
FIG. 2 shows a portion of a rotor of the oscillating motor according to FIG. 1 in an axial view.
Figure 1:
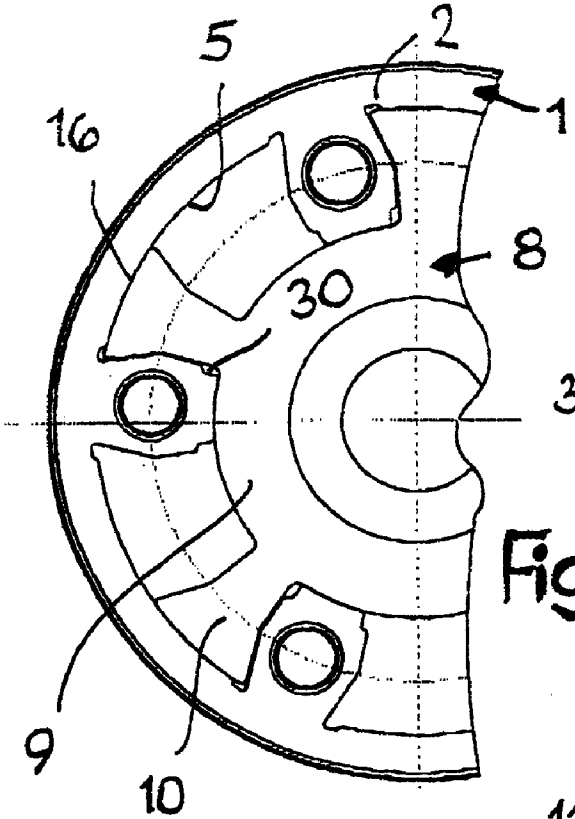
FIG. 1 shows in an axial view a portion of a first embodiment of the oscillating motor according to the invention for a camshaft adjusting device.

In order for this gap length 16 to be enlarged without obtaining the oscillating or rotary angle of the rotor 8 relative to the stator 1 by size enlargement of the oscillating motor, the rotor vanes 10 are widened in their radially outer section (FIGS. 1 and 2). This widened section 17 extends in the illustrated embodiment approximately across half the radial length of the rotor vanes 10. The radially inwardly positioned section 18 of the rotor vane adjoining the base member is significantly narrower in comparison to the radially outwardly positioned widened section 17. The width of the section 17 in the area of the end face 11 is approximately one and a half to three times the width of the radially inner section 18. The widened section 17 is delimited by two plane sidewalls 19, 20 that diverge radially outwardly and are connected to one another by the continuously curved end face 11. The two lateral surfaces 21, 22 extend in the radial direction and parallel to one another and pass into the sidewalls 19, 20 at an obtuse angle.

The stator vanes 6 are matched to the shape of the rotor vanes 10. The stator vanes 6 have sidewalls 23, 24 adjoining at an acute angle the inner wall 5 of the stator housing 2 against which the sidewalls 19, 20 of the widened section 17 (FIG. 1) of the rotor vanes 10 rest in the respective end position (stop position). Accordingly, the sidewalls 23, 24 of the stator vanes 6 diverge radially inwardly. The sidewalls 23, 24 are planar and pass at an obtuse angle into plane sidewalls 25, 26 against which the lateral surfaces 21, 22 the rotor vanes 10 rest areally in the respective end position.

At the transition from the inner wall 5 into the respective sidewall 23, 24 of the stator vanes 6 a groove-shaped recess 27, 28 is provided, respectively, which serves as a dirt collecting pocket into which dirt particles contained in the hydraulic medium can be displaced during operation of the oscillating motor. With these recesses 27, 28 it is thus prevented that the dirt particles can become lodged or jammed between the sidewalls of the rotor vanes 10 and the stator vanes 6. This ensures that the rotor vanes 10 in the respective end position reliably rests against the sidewalls of the stator vanes 6.

At the transition from the radially inwardly positioned, continuously curved end face 12 of the stator vane 6 into the sidewalls 25, 26, a recess 29, 20 is provided, respectively. In this way, in the stop position between the rotor vanes 10 and the stator vanes 6 free space remains in the area of the rotor base member 9 into which the pressure medium can flow in order to rotate the rotor 8 in the clockwise direction relative to the stator 1.

Since the rotor vanes 10 are widened in the radially outwardly positioned section 17 while they are narrowed in the radially inwardly positioned section 18, the rotor 8 can be rotated relative to the stator 1 by a relatively large angle without the outer dimensions of the stator 1 being enlarged. Despite this, the sealing gap 16, formed between the end face 11 of the rotor vane 10 and the inner wall 5 of the stator housing 2, has a great length as a result of the widened section 17. Leakage of the oscillating motor is significantly reduced because, as a result of the great gap length, the two pressure chambers 14, 15 on both sides of the rotor vanes 8 are sealed more effectively. In this way, it is ensured that the rotor 8 relative to the stator 1 during the time of use of the oscillating motor can always be rotated about the same oscillating angle. This ensures that the camshaft can be precisely adjusted relative to the crankshaft during the entire service life of the oscillating motor.

As shown in FIG. 1, in the respective stop position, the rotor vanes 8 project with their transition area 31, 32 (FIG. 2) formed between the end faces 11 and the sidewalls 19, 20 partially into the recesses 27, 28 in the area of the inner housing wall 5. This contributes to the fact that the rotor 8, despite being widened in its radially outer section 17, can be relatively rotated by a relatively large oscillating angle relative to the stator 1.

In deviation from the illustrated embodiment, widening of the rotor vanes 10 in the circumferential direction can be realized also in the last third of the rotor vanes (viewed in the radial direction outwardly) so that the narrow section 18 of the rotor vane 10 can extend across a correspondingly large length in the radial direction.

In the embodiment according to FIGS. 4 through 6, the rotor vanes 10 are also widened in the circumferential direction in the radially outer section 17 while the radially inner area 18 adjoining the base member 9 is relatively narrow. The plane sidewalls 21, 22 of the inner section 18 pass continuously curved into the plane sidewalls 19, 20 of the radially outwardly positioned section 17 of the rotor vanes 10. In contrast to the preceding embodiment, the radially outwardly positioned, circumferentially widened section 17 of the rotor vanes has a smaller radial width than in the preceding embodiment. As a result of this configuration, the widened section 17 can be even longer in the circumferential direction than in the embodiment of FIGS. 1 through 3. The recesses 27, 28 positioned between the inner wall 5 of the housing and the sidewalls 23, 24 of the stator vanes 6 are thus deeper in the circumferential direction than in the preceding embodiment. In this way, it is ensured that the rotor 8 despite the widened section 17 of its rotor vanes 10 has the same oscillating angle as the rotor 8 according to FIGS. 1 through 3. The outer dimensions of the stator 1 are identical to the preceding embodiment.

The stator 1 and the rotor 8 are otherwise identical to the embodiment of FIGS. 1 through 3.

Figures 7, 8, 9:
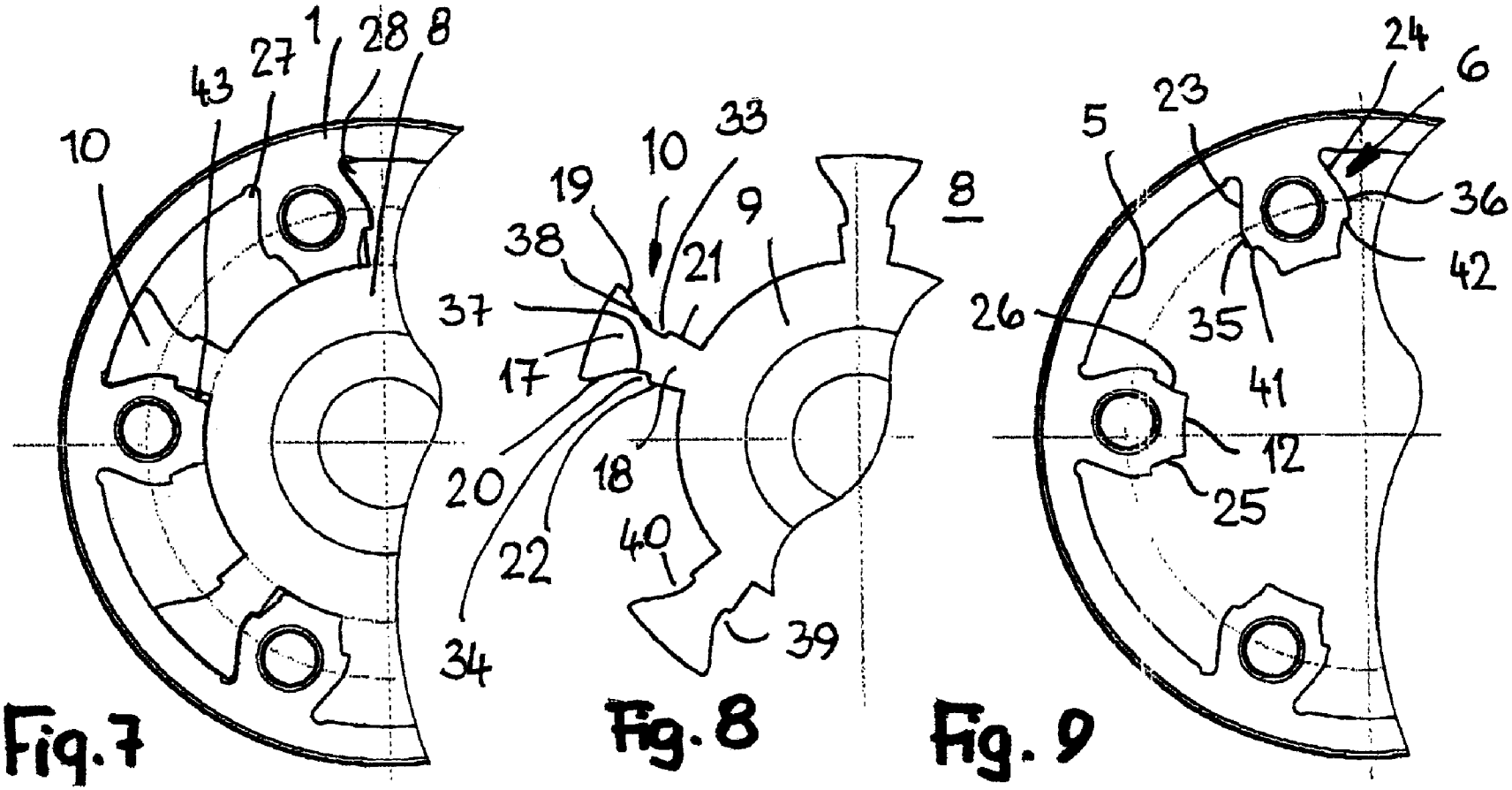
FIG. 7 shows a third embodiment of the oscillating motor according to the invention in a representation corresponding to FIG. 1.
FIG. 8 shows the third embodiment of the oscillating motor according to the invention in a representation corresponding to FIG. 2.
FIG. 9 shows the third embodiment of the oscillating motor according to the invention in a representation corresponding to FIG. 3.

FIGS. 7 though 9 show an embodiment in which the radially inner section 18 of the rotor vanes 10 which adjoin the cylindrical base member 9 of the rotor 8 has two radially extending plane sidewalls 21, 22 which in the radial direction are shorter than in the preceding embodiments. The radially outwardly positioned section 17 of the rotor vane 10 is configured in accordance with the embodiment of FIGS. 1 through 3 and has plane radially outwardly diverging lateral surfaces 19, 20. These lateral surfaces 19, 20 pass into sidewalls 21, 22 of the radially inwardly positioned section 18 via a circumferentially extending shoulder 33, 34, respectively.

The stator vanes 6 have planar lateral surfaces 23, 24 diverging radially inwardly from the inner housing wall 5; the lateral surfaces 19, 20 of the rotor vanes 10 rest areally against them in the stop position. The sidewalls 23, 24 are positioned at an obtuse angle relative to the sidewalls 35, 36 which are planar and parallel to one another. In their end position, the rotor vanes 10 rest with the plane bottom 37, 38 of their recesses 39, 40 areally against the sidewalls 35, 36; the recesses 39, 40 are provided in the sidewalls of the rotor vanes 10. The bottoms 37 adjoin approximately at a right angle the shoulders 33, 34 which connect the bottoms 37, 38 to the sidewalls 21, 22. The lateral recesses 39, 40 are provided approximately at half the radial length of the rotor vane 10.

The sidewalls 35, 36 of the stator vanes 6 adjoin approximately at a right angle the shoulder surfaces 41, 42 which are oriented inwardly and connect the sidewalls 35, 36 and the lateral surfaces 25, 26. At their free end the lateral surfaces 25, 26 are connected by the end face 12 with which the stator vanes 6 rests areally on the base member 9 of the rotor 8. The two sidewalls 25, 26 converge radially inwardly. In this way, in the stop position of the rotor vanes 10 (FIG. 7) a radially inwardly widening free space 43 is provided between the sidewalls 21, 22 of the rotor vane 10 and the sidewalls 25, 26 of the stator vanes 6 into which the hydraulic medium can flow when the rotor 8 is to be rotated from the stop position illustrated in FIG. 7 in the clockwise direction relative to the stator 1. When the rotor vane 10 rests with its other lateral surface against the neighboring stator vane 6, a corresponding free space is formed in the same way.

In the respective stop position, the rotor vanes 10 project with the corner area of their outer widened sections 17 into the pocket-shaped recesses 27, 28 provided at the foot of the stator vanes 6.

Figure 10:
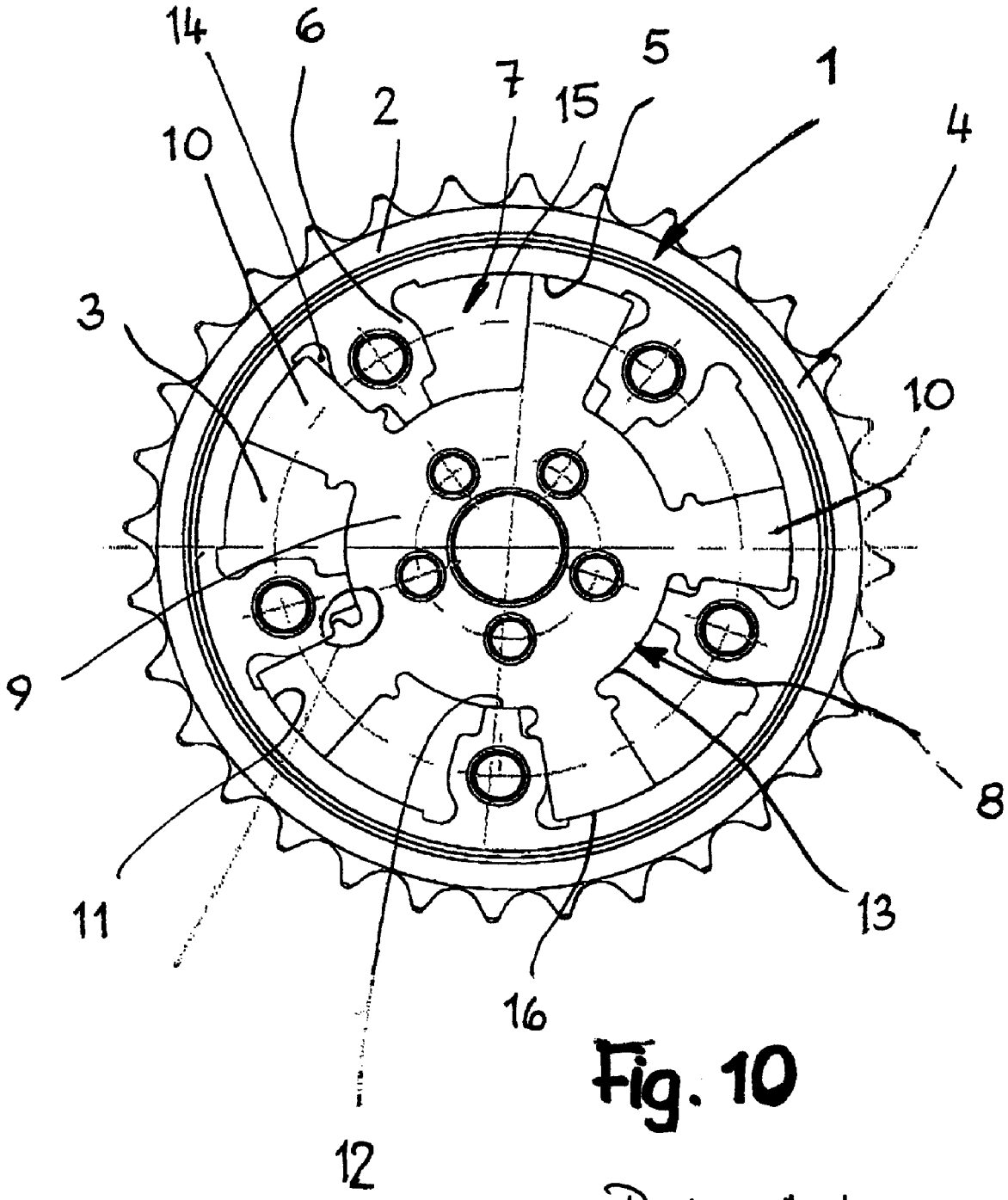
Fig. 10 Prior Art
FIG. 10 is an axial view of an oscillating motor according to the prior art.

When rotating the rotor 8 relative to the stator 1, the medium, which is in the pressure chambers in front of the rotor vane 10, when viewed in the rotational direction, is displaced toward the tank while the pressure medium in those chambers that are behind the rotor vanes 10 in the rotational direction is pressurized. As a result of the recesses 27, 28 located at the foot of the stator vane 6 as well as the recesses 29, 30 provided at the free end of the stator vanes 6 a damping effect is obtained so that the rotor vanes 10 will not collide hard with the lateral walls of the stator vane 6. In the described embodiments, the rotor 8 can rotate relative to the stator 1 by a larger angle because the rotor vanes 10 are narrow at their radially inwardly positioned section 18. In this way, the camshaft can be adjusted across a wider angular range relative to the crankshaft by means of the oscillating motor. At the same time, leakage of the oscillating motor is significantly reduced because as a result of the widened sections 17 of the rotor vanes 10 the sealing gap 16 between the end face 11 of the rotor vanes 10 and of the inner wall 5 of the housing 2 is long. The functional limits of the oscillating motor and thus also of the camshaft adjusting device are thus significantly broadened in comparison to conventional systems (FIG. 10). The rotor vanes 10 do not widen radially outwardly in a continuous way but widen only within the section 17.

While specific embodiments of the invention have been shown and described in detail to illustrate the inventive principles, it will be understood that the invention may be embodied otherwise without departing from such principles.

What is claimed is:

1. An oscillating motor comprising:

a stator and a rotor mounted so as to be rotatable relative to one another, wherein the rotor is adapted to be fixedly mounted on a camshaft for effecting an adjustment of the camshaft relative to a crankshaft;

wherein the stator has an inner wall and radially inwardly extending stator vanes connected to the inner wall;

wherein the rotor has a base member and radially outwardly extending rotor vanes connected to the base member, wherein pressure chambers are delimited between sidewalls of the rotor vanes and sidewalls of the stator vanes, respectively;

wherein the rotor vanes each have an end face resting against the inner wall of the stator;

wherein the stator vanes have an end face, respectively, resting against a peripheral wall of the base member;

wherein between the end face of the rotor vanes and the inner wall of the stator a sealing gap is formed, respectively;

wherein the rotor vanes taper discontinuously from the end face of the rotor vanes, respectively, in a direction toward the base member so that the rotor vanes each have a widened section at the end face and a radially inwardly positioned section connecting the widened section to the base member, respectively;

wherein the widened section increases a gap length of the sealing gap so that a sealing action between the pressure chambers on opposite sides of the rotor vanes is optimized and leakage between pressure chambers on opposite sides of the rotor vanes is reduced;

wherein the sidewalls of the stator vanes diverge radially inwardly beginning at the inner wall of the stator and match a shape of the sidewalls of the rotor vanes;

wherein the sidewalls of the stator vanes each have a first recess at the end face, respectively, wherein the first recesses face the rotor vanes and cause a damping effect when the rotor vanes approach the stator vanes;

wherein the widened section has a width at the end face matching approximately 1.5 to 3 times a width of the radially inwardly positioned section;

wherein the radially inwardly positioned section of the rotor vanes has substantially a constant width across a length of the radially inwardly positioned section.

2. The oscillating motor according to claim 1, wherein the stator has second recesses in a transition area from the sidewalls of the stator vanes into the inner wall of the stator.

3. The oscillating motor according to claim 1, wherein the widened section extends across at least one third of a radial length of the rotor vanes.

4. The oscillating motor according to claim 1,wherein the widened section has lateral surfaces converging from the end face of the rotor vanes toward the base member.

5. The oscillating motor according to claim 4, wherein the lateral surfaces of the widened sections are planar.

6. The oscillating motor according to claim 4, wherein the lateral surfaces of the widened sections are positioned at an obtuse angle relative to lateral surfaces of the radially inwardly positioned section of the rotor vanes.

7. The oscillating motor according to claim 6, wherein the lateral surfaces of the radially inwardly positioned section are approximately parallel to one another.

8. The oscillating motor according to claim 2, wherein the widened sections of the rotor vanes, when the rotor vanes rest in a stop position against the stator vanes, engage the second recesses of the stator.

9. The oscillating motor according to claim 6, wherein the lateral surfaces of the widened section pass arc-shaped into the lateral surfaces of the radially inwardly positioned section.

10. An oscillating motor comprising;

a stator and a rotor mounted so as to be rotatable relative to one another, wherein the rotor is adapted to be fixedly mounted on a camshaft for effecting an adjustment of the camshaft relative to a crankshaft;

wherein the stator has an inner wall and radially inwardly extending stator vanes connected to the inner wall;

wherein the rotor has a base member and radially outwardly extending rotor vanes connected to the base member, wherein pressure chambers are delimited between sidewalls of the rotor vanes and sidewalls of the stator vanes, respectively;

wherein the rotor vanes each have an end face resting against the inner wall of the stator;

wherein the stator vanes have an end face, respectively, resting against a peripheral wall of the base member;

wherein between the end face of the rotor vanes and the inner wall of the stator a sealing gap is formed, respectively;

wherein the rotor vanes taper discontinuously from the end face of the rotor vanes, respectively, in a direction toward the base member so that the rotor vanes each have a widened section at the end face and a radially inwardly positioned section connecting the widened section to the base member, respectively;

wherein the widened section increases a gap length of the sealing gap so that a sealing action between the pressure chambers on opposite sides of the rotor vanes is optimized and leakage between pressure chambers on opposite sides of the rotor vanes is reduced;

wherein the sidewalls of the stator vanes diverge radially inwardly beginning at the inner wall of the stator and match a shape of the side walls of the rotor vanes;

wherein the sidewalls of the stator vanes each have a first recess at the end face, respectively, wherein the first recesses face the rotor vanes and cause a damping effect when the rotor vanes approach the stator vanes;

wherein the widened section has a width at the end face matching approximately 1.5 to 3 times a width of the radially inwardly positioned section;

wherein the widened section has lateral surfaces converging from the end face of the rotor vanes toward the base member;

wherein the lateral surfaces of the widened sections are positioned at an obtuse angle relative to lateral surfaces of the radially inwardly positioned section of the rotor vanes;

recesses provided at a transition from the lateral surfaces of the radially inwardly positioned section into the lateral surfaces of the widened section.

11. The oscillating motor according to claim 10, wherein the radially inwardly positioned section of the rotor vanes has substantially a constant width across a length of the radially inwardly positioned section.

12. An oscillating motor comprising:

a stator and a rotor mounted so as to be rotatable relative to one another, wherein the rotor is adapted to be fixedly mounted on a camshaft for effecting an adjustment of the camshaft relative to a crankshaft;

wherein the stator has an inner wall and radially inwardly extending stator vanes connected to the inner wall;

wherein the rotor has a base member and radially outwardly extending rotor vanes connected to the base member;

wherein the rotor vanes have an end face, respectively, resting against the inner wall of the stator;

wherein the stator vanes have an end face, respectively, resting against a peripheral wall of the base member;

wherein the rotor vanes each have a widened section at the end face, wherein the widened section extends across at least one third to approximately one half of a radial length of the rotor vanes, respectively;

wherein the rotor vanes each have a radially inwardly positioned section connecting the widened section to the base member, respectively;

wherein the radially inwardly positioned section has substantially a constant width across a length of the radially inwardly positioned section;

wherein the stator vanes have sidewalls that diverge radially inwardly beginning at the inner wall of the stator and match a shape of sidewalls of the rotor vanes;

wherein the sidewalls of the stator vanes each have a recess at the end face, respectively, wherein the recesses face the rotor vanes and cause a damping effect when the rotor vanes approach the stator vanes;

wherein the widened section has a width at the end face matching approximately 1.5 to 3 times a width of the radially inwardly positioned section.

13. An oscillating motor comprising:

a stator and a rotor mounted so as to be rotatable relative to one another, wherein the rotor is adapted to be fixedly mounted on a camshaft for effecting an adjustment of the camshaft relative to a crankshaft;

wherein the stator has an inner wall and radially inwardly extending stator vanes connected to the inner wall;

wherein the rotor has a base member and radially outwardly extending rotor vanes connected to the base member;

wherein the rotor vanes have an end face, respectively, resting against the inner wall of the stator;

wherein the stator vanes have an end face, respectively, resting against a peripheral wall of the base member;

wherein the rotor vanes have sidewalls that taper discontinuously from the end face of the rotor vanes, respectively, in a direction toward the base member so that the rotor vanes each have a widened section at the end face and a radially inwardly positioned section, respectively;

wherein the radially inwardly positioned section of the rotor vanes has substantially a constant width across a length of the radially inwardly positioned section;

wherein the stator vanes have sidewalls that diverge radially inwardly beginning at the inner wall of the stator and match a shape of the sidewalls of the rotor vanes;

wherein the sidewalls of the stator vanes each have a recess at the end face, respectively, wherein the recesses face the rotor vanes and cause a damping effect when the rotor vanes approach the stator vanes;

wherein the widened section has a width at the end face matching approximately 1.5 to 3 times a width of the radially inwardly positioned section.

* * * * *